US006854714B1

(12) United States Patent
Wood

(10) Patent No.: US 6,854,714 B1
(45) Date of Patent: Feb. 15, 2005

(54) STAPLE PULLER WITH PLIERS FOR REMOVING STRAGGLERS

(76) Inventor: Lawson A. Wood, 873 N. Frederick St., Arlington, VA (US) 22205

( * ) Notice: Subject to any disclaimer, the term of this patent is extended or adjusted under 35 U.S.C. 154(b) by 0 days.

(21) Appl. No.: 10/728,819

(22) Filed: Dec. 8, 2003

(51) Int. Cl.[7] ..... B25C 11/00
(52) U.S. Cl. ..... 254/28
(58) Field of Search ..... 254/28, 22, 21, 254/18; 7/166, 165, 125

(56) References Cited

U.S. PATENT DOCUMENTS 3,630,486 A * 12/1971 Foitle ..... 254/28
5,090,662 A * 2/1992 Koo ..... 254/28
5,292,106 A * 3/1994 Li ..... 254/28
5,938,178 A * 8/1999 Oh ..... 254/28
6,349,923 B1 * 2/2002 Goodell ..... 254/28

* cited by examiner

*Primary Examiner*—Lee D. Wilson

(57) ABSTRACT

A staple puller includes a pair of pivotably connected jaw members that are made from sheet metal. The jaw members have teeth that are configured to hook under a staple and pull it from a stack of pages. But sometimes one leg of a staple remains embedded in the stack after the other leg is pulled free, thus producing a "straggler" that may be difficult to remove if the stack is relatively thick. Accordingly, one of the jaw members is provided with a bent flange that cooperates with an edge of the other jaw member in the manner of pliers so that a straggler can be gripped and pulled out.

13 Claims, 1 Drawing Sheet

STAPLE PULLER WITH PLIERS FOR REMOVING STRAGGLERS

BACKGROUND OF THE INVENTION

The present invention is directed to an improved staple puller for removing wire staples from pages of paper. More particularly, the invention is directed to a staple puller that is provided with clamping surfaces for gripping the wire of a staple that has one leg removed from the pages and the other leg still embedded in the pages, so that the embedded leg can be pulled free.

FIG. 1 illustrates a left side view of a conventional staple puller 10. It includes a first jaw member 12, a second jaw member 14, and a rivet 16 that extends through holes in the members 12 and 14 to pivotably join them together. The jaw members 12 and 14 are made from sheet metal and are generally U-shape in cross-section. That is, the jaw member 12 includes a left side wall 18, a right side wall (not shown) having the same shape as the wall 18, and a back wall (not shown) that joins the left and right side walls. Similarly, the jaw member 14 includes a left side wall 20, a right side wall (not shown) having the same shape as the left side wall, and a back wall (not shown) that joins the left and right side walls. The back wall of the jaw member 14 has a width that is slightly smaller than the width of the back wall of the jaw 12, so that the side walls of the jaw member 14 can be accommodated between the side walls of the jaw member 12.

At the front end portion 24 of the staple puller 10, the jaw members 12 and 14 have teeth 26. A spring 28 is wrapped around the rivet 16 and has legs that engage the back walls of the members 12 and 14, urging the staple puller 10 to an open position wherein the teeth 26 are spread apart. However, the staple puller 10 can be moved to a closed position by pressing the jaw members 12 and 14 together against the force of the spring 28. Plastic finger grips 30 are mounted on the jaw members to facilitate moving the staple puller 10 to its closed position.

During use, the teeth 26 of either the first or second jaw member 12 or 14 are hooked under the wire of the staple that is to be removed from a group of papers, and the staple puller 10 is then squeezed toward its closed position. This slides the teeth of the other jaw member under the staple, too. Further movement of the staple puller 10 toward its closed position generally pulls the staple from the group of papers.

FIG. 2 illustrates a problem that sometimes occurs during this process. Here, one leg 32 of a staple that has been mangled during a staple-puling attempt remains embedded in a stack 34 of paper. This is what I call a "straggler." An attempt to remove a straggler with one's fingers is rarely successful and may result in a paper cut or puncture wound by the wire. Scissors can sometimes be used to pry out a straggler, but more frequently the problem is solved by grabbing half of the stack with one hand and half with the other hand and then pulling them apart, thus freeing the straggler from half of the stack while leaving it embedded in the other half. The process is then repeated until the straggler can be extracted with the fingers. This removes the straggler but usually damages at least some of the papers.

SUMMARY OF THE INVENTION

The object of the present invention is to provide an inexpensive staple puller with built-in pliers that provide clamping surfaces for gripping a straggler, to facilitate its extraction.

This object can be attained by providing a bent flange on one of the jaw members to cooperate with an edge on the other jaw member in the manner of pliers, permitting a straggler to be gripped and extracted. The pliers may be located forward of the rivet that pivotably connects the jaw members. However, the pliers are preferably located behind the rivet so that the pliers can grip the straggler closer to the paper, without the finger grips getting in the way and preventing a close-in grip.

Pliers are preferably provided at both the left side walls and the right side walls of the jaw members. This permits left side and right side flanges to be located at the same height and come into contact with edge surface of the other jaw member simultaneously, stopping the closure of the jaw members symmetrically even if manufacturing tolerances are loose.

DESCRIPTION OF THE PREFERRED EMBODIMENT

Figure 1:
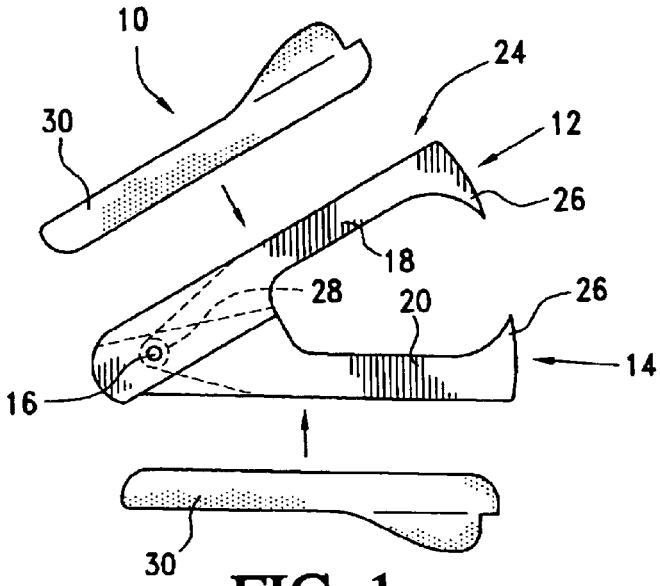
FIG. 1 (PRIOR ART)
FIG. 1 is a side view of a prior art staple puller.
Figure 2:
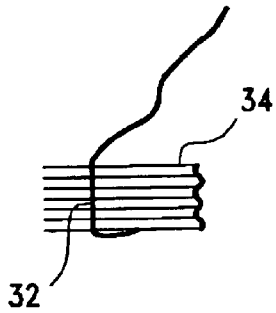
FIG. 2 is a cross sectional view of a corner portion of a stack of pages, with a straggler embedded in the stack.
Figure 3:
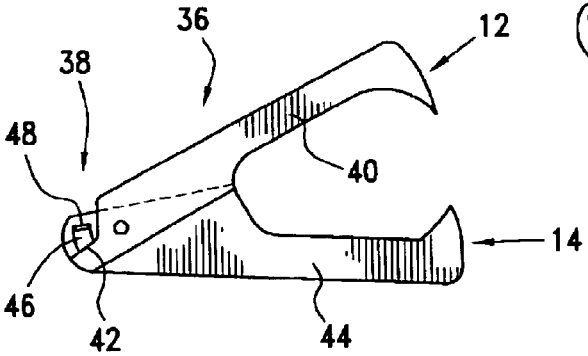
FIG. 3 is a side view of a staple puller in accordance with the present invention, without its finger grips.
Figure 5:
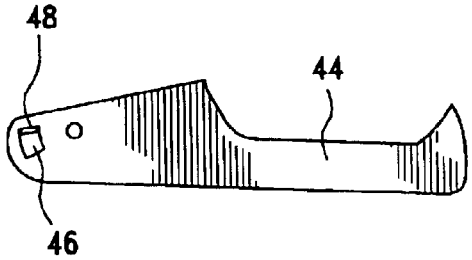
FIG. 5 is a side view of the other jaw member of the staple puller shown in FIG. 3.
Figure 4:
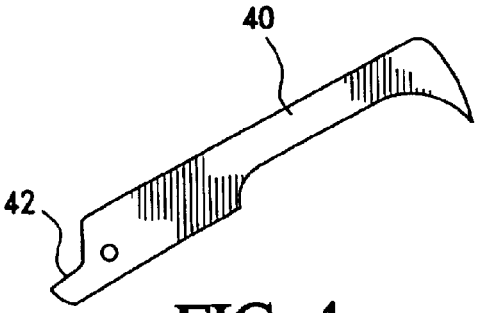
FIG. 4 is a side view of one jaw member of the staple puller shown in FIG. 3.

The right side of an improved staple puller 36 in accordance with the present invention is shown (without its finger grips 30) in FIG. 3. Its construction is the same as that of the staple puller 10 shown in FIG. 1, except at the back end portion 38. The left side wall 40 of the first jaw member 12 is shown in FIG. 4, and includes a clamping surface 42. The left side wall 44 of the second jaw member 14 is shown in FIG. 5. It includes a slot 46 with a bent-out flange 48 at the slot's upper end. The flange 48 provides a clamping surface that is positioned to meet the clamping surface 42 when the staple puller 36 is moved to its closed position. The clamping surfaces 42 and 48 act as the jaws of pliers to grip a straggler that has been inserted through the slot 46, so that the straggler can be pulled out.

Figure 6:
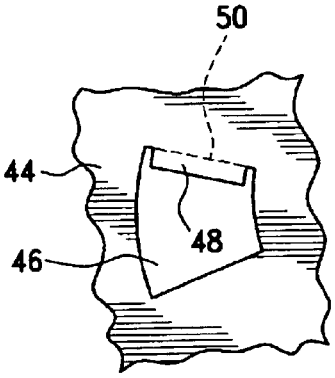
FIG. 6 shows a broken-away portion of the jaw member illustrated in FIG. 5, before a flange is bent outward.

FIG. 6 illustrates a small part of the side wall 44 during manufacture of the jaw member 14. When the slot 46 is punched out, a tab of sheet metal is left extending into the slot. This tab is then bent outward from the plane of the paper, along dotted line 50, to become the flange 48.

Although not shown, it is preferable that clamping surfaces be provided on the right side walls as well.

It will be apparent to those skilled in the art that the staple puller described above is susceptible to various changes, modifications, and adaptations, and it is therefore intended that such changes, modifications, and adaptations be included within the scope and range of equivalents of the appended claims. One possible modification that should be mentioned is that the clamping surfaces 42 and 48 (preferable on both side walls) can be located forward of the rivet that holds the jaw members 12 and 14 together. However, depending on the configuration of the finger grips 30, this might mean that the straggler could not be gripped very close to the top sheet of paper.

What I claim is:

1. A staple puller for removing a wire staple from a stack of pages, comprising:

a first jaw member having a first side wall with a front end portion and a back end portion, the front end portion of the first side wall having a first tooth that is configured to slide under the staple, the first side wall also having a first clamping surface;

a second jaw member having a second side wall with a front end portion and a back end portion, the front end portion of the second side wall having a second tooth that is configured to slide under the staple, the second side wall also having an edge that provides a second clamping surface; and means for pivotably connecting the first and second jaw members so that they are movable with respect to one another between an open position and a closed position, the first and second teeth being disposed side-by-side in the closed position and the first and second clamping surfaces facing one another in the closed position so as to permit the wire of the staple to be gripped between the clamping surfaces if the staple has been removed only partially from the stack of pages, wherein the first side wall has a slot and a flange at an edge of the slot, the flange providing the first clamping surface; and wherein the first side wall has a major portion that includes the first tooth and that lies substantially in a plane, and the flange extends transverse to the plane so as to overlap the second clamping surface when the jaw members are in their closed position.

2. The staple puller of claim 1, wherein the first side wall has a first hole between the front end portion and back end portion thereof, wherein the second side wall has a second hole between the front end portion and back end portion thereof, and wherein the means for pivotablt connecting extends through the first and second holes.

3. The staple puller of claim 2, wherein the means for pivotably connecting comprises a rivet.

4. The staple puller of claim 3, further comprising a spring that urges the first and second jaw members toward the open position.

5. The staple puller of claim 4, further comprising a first plastic finger grip attached to the first jaw member and a second plastic finger grip attached to the second jaw member.

6. The staple puller of claim 2, wherein the first and second clamping surfaces are located at the back end portions of the first and second side walls, respectively.

7. The staple puller of claim 1, wherein the first and second jaw members are made from sheet metal.

8. The staple puller of claim 7, wherein the slot is a closed slot that is surrounded on all sides by sheet metal.

9. The staple puller of claim 1, wherein the second clamping surface and the second tooth lie in a common plane.

10. An improved staple puller of the type that includes first and second jaw members that are made from sheet metal, and means for pivotably connecting the first and second jaw members so that they are movable between an open position and a closed position, the first jaw member having side walls with teeth and the second jaw member having side walls with teeth, the teeth of the first jaw member being disposed between the teeth of the second jaw member when the jaw members are in their closed position, wherein the improvement comprises:

at least one of the side walls has a bent flange that provides a clamping surface, the clamping surface provided by the flange being aligned with an edge of another of the side walls so as to overlap said edge when the jaw members are in their closed position.

11. The improved staple puller of claim 10, wherein the bent flange of the at least one of the side walls extends outward from the at least one of the side walls at an edge of a slot in the at least one of the side walls, the slot being a closed slot that is surrounded on all sides thereof by sheet metal.

12. An improved staple puller of the type that includes first and second jaw members that are made from sheet metal, and means for pivotably connecting the first and second jaw members so that they are movable between an open position and a closed position, the first jaw member having side walls with teeth and the second jaw member having side walls with teeth, the teeth of one of the jaw members being disposed between the teeth of the other of the jaw members when the jaw members are in their closed position, wherein the improvement comprises:

the first jaw member has an edge that provides a first clamping surface, and the second jaw member has a closed slot that is surrounded on all sides by sheet metal, and a flange at an edge of the slot that is bent outward from the sheet metal adjacent the slot such that a side of the flange provides a second clamping surface that overlaps the first clamping surface when the jaw members are in their closed position.

13. The improved staple puller of claim 12, wherein the edge that provides the first clamping surface is an edge of one of the side walls of the first jaw member, and the slop in the second jaw member is located in one of the side walls of the second jaw member.

* * * * *